US005130720A

United States Patent [19]

Lopez et al.

[11] Patent Number: 5,130,720

[45] Date of Patent: Jul. 14, 1992

[54] SYSTEM FOR DRIVING INK JET TRANSDUCERS AND METHOD OF OPERATION

[75] Inventors: Juan E. Lopez, Newbury Park; Edgar D. Sheh, Thousand Oaks, both of Calif.

[73] Assignee: Dataproducts Corporation, Woodland Hills, Calif.

[21] Appl. No.: 611,032

[22] Filed: Nov. 9, 1990

[51] Int. Cl.[5] ..... B41J 2/045

[52] U.S. Cl. ..... 346/1.1; 346/140 R; 346/76 PH

[58] Field of Search ..... 346/140 R, 1.1, 76 PH

[56] References Cited

U.S. PATENT DOCUMENTS

| | | | |
|---|---|---|---|
| 4,424,520 | 1/1984 | Matsuda et al. | 346/140 R |
| 4,492,968 | 1/1985 | Lee et al. | 346/140 R |
| 4,514,737 | 4/1985 | Suzuki | 346/76 PH |
| 4,521,786 | 6/1985 | Bain | 346/140 R |
| 4,684,959 | 8/1987 | Mori et al. | 346/76 PH |
| 4,686,539 | 8/1987 | Schmidle et al. | 346/1.1 |
| 4,719,473 | 1/1988 | Shimamura | 346/76 PH |
| 4,897,665 | 1/1990 | Aoki | 346/1.1 |
| 4,908,635 | 3/1990 | Iwasawa et al. | 346/140 R |

FOREIGN PATENT DOCUMENTS

| | | | |
|---|---|---|---|
| 0278047 | 12/1987 | Japan | 346/140 R |

*Primary Examiner*—Benjamin R. Fuller
*Assistant Examiner*—Alrick Bobb
*Attorney, Agent, or Firm*—Spensley Horn Jubas & Lubitz

[57] ABSTRACT

A drive system for driving the transducers of an ink jet print head. A controller determines transducer activation periods during which one or more selected transducers are to be activated. During each transducer activation period a voltage source is activated. A drive circuit receives serial print data from the controller and couples the selected transducers to the voltage source. The voltage source can be provided with a waveshape circuit to produce a desired excitation waveshape.

8 Claims, 2 Drawing Sheets

SYSTEM FOR DRIVING INK JET TRANSDUCERS AND METHOD OF OPERATION

BACKGROUND OF THE INVENTION

1. Field of the Invention

The present invention relates to systems for driving the transducers in ink jet print heads. In particular, to a drive system with a voltage source having waveshape circuit for shaping the voltage supplied to the transducers and a method of operating the source.

2. Description of Related Art

In typical ink jet printers, a print head having one or more ink jets is moved back and forth over a target. As the print head moves, ink drops are ejected from the ink jets and impact the target to form images. The printer is generally provided with a controller which monitors movement of the print head and controls ejection of the ink drops such that the drops hit the target in the proper locations to form desired images.

Each ink jet in such print heads typically includes a orifice in communication with a variable volume chamber. The chamber is filled with ink supplied from an ink reservoir. A transducer is coupled with the chamber such that activation of the transducer causes the volume of the chamber to change to thereby eject a drop of ink from the orifice toward the target. A voltage source, typically not located on the print head, supplies a constant voltage to the print head. A drive circuit on the print head, in response to signals received from the controller, activates any particular transducer by coupling it to the constant voltage source at the desired time.

It is known that the shape and velocity of the ejected ink drop, and other factors which influence the ultimate quality and resolution of the printed image, depend, to some extent, on the excitation waveshape the plot of voltage applied to the transducer over time, applied to the transducer. Therefore, it is usually desirable for each transducer to be driven with the same excitation waveshape. It is also frequently desirable to drive the transducers with a particular waveshape to achieve ink drops with desired properties. However, because of manufacturing variations and the like, each transducer typically has a slightly different capacitance. As a result, when the constant voltage is applied to different transducers, each having a different capacitance, the excitation waveshape for each transducer may vary slightly.

To compensate for this problem, each transducer in a print head is typically coupled with a series network, usually a series resistor to control rise time and a diode in series with a second resistor to control fall time, to adjust the individual excitation waveshape for each transducer to a desired excitation waveshape. However, as can be appreciated, the individual adjustment of the excitation waveshape for each transducer in a print head can be very inefficient and costly. More importantly, the provision of a series network for each transducer can consume a relatively large amount of space on a print head, particularly for print heads having a large number of ink jets. This frequently requires the use of larger, more cumbersome print heads, which can adversely affect many other aspects of printer performance and design.

SUMMARY OF THE INVENTION

Accordingly, it is an object of the present invention to provide an improved transducer drive system that is compact and efficient.

Another object of the invention is to provide a transducer drive system which drives each transducer with a consistent and desirable excitation waveshape.

A further object of the invention is to provide an improved transducer drive system which is inexpensive, easy to manufacture, and reliable.

In accordance with these and other objects, a transducer drive system in accordance with a preferred embodiment of the present invention comprises a print head having a plurality of ink jets. Each ink jet has an associated transducer which can be activated to eject ink from the ink jet. A controller determines a transducer activation period during which selected transducers are to be activated. In response to the controller, a voltage source generates a drive voltage during the activation period. A drive circuit is used to apply the drive voltage to the selected transducers during the transducer activation period.

In accordance with another aspect of the invention the drive voltage is shaped to a desired excitation waveshape by a waveshape circuit. During the transducer excitation period, the excitation waveshape is applied simultaneously to the selected transducers.

Other objects and aspects of the invention will become apparent to those skilled in the art from the detailed description of the invention which is presented by way of example and not as a limitation of the present invention.

DESCRIPTION OF THE ILLUSTRATED EMBODIMENT

Figure 1:
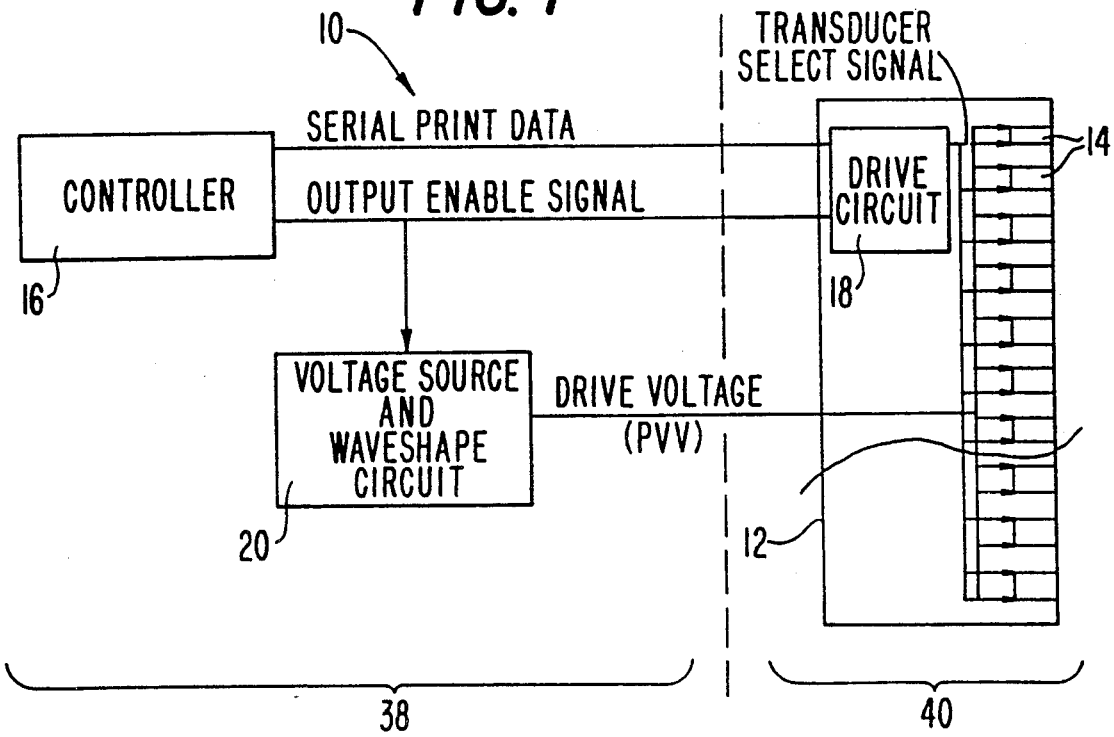
FIG. 1 is a block diagram of a drive system in accordance with a preferred embodiment of the present invention.

A block diagram of a transducer drive system in accordance with a preferred embodiment of the present invention is indicated by reference numeral 10 in FIG. 1. The drive system is ideally suited for use with an ink jet print head 12 (illustrated in block form) having a plurality of transducers 14 which, upon activation, eject ink from the print head onto a target. The drive system 10 includes a controller 16 which monitors movement of the print head 12 and determines when each transducer 14 should be activated to eject ink, and thereby form a desired image on the target.

The controller 16 serves at least two distinct functions. First, the controller 16 provides serial print data indicative of which transducers 14 must be actuated at any given time. This information is provided to a drive circuit 18 which utilizes the print data to select the transducers which should be activated at any given time. Second, the controller 16 determines the time at which any group of selected transducers 14 must be activated. At the appropriate time, in response to the controller, a voltage source and waveshape circuit 20 is activated to produce an activation voltage for the transducers 14. At the same time, also in response to the controller 16, the drive circuit 18 activates the selected transducers 14 by coupling them with the drive voltage and waveshape circuit 20. In this manner, by selectively activating the appropriate transducers at the appropriate times, the controller produces the desired image on the target.

In the illustrated embodiment, the controller operates to activate groups of one or more selected transducers simultaneously. Further, the controller operates to activate only one group of selected transducers at any given time. That is, the controller determines a transducer activation period. At the outset of the transducer activation period the controller produces an output enable signal which activates, or turns on, the voltage source and waveshape circuit 20 which produces a drive voltage. At the same time, the output enable signal is provided to the drive circuit 18 which selects one or more transducers, based on the serial print data. The drive voltage is applied to the selected transducers and the selected transducers are activated more or less simultaneously. At the end of the transducer activation period, the controller deactivates, or turns off, the voltage source. The voltage source remains deactivated and no more transducers are activated until the next transducer activation period.

As can be appreciated, the voltage source and waveshape circuit of a drive system in accordance with a preferred embodiment of the present invention is not always turned on. Rather, the voltage source is turned on only during the transducer activation periods and is turned off when no transducers are being activated. This increases the efficiency of the system and increase the life expectancy of the voltage source, thereby improving the reliability of the drive system.

It should also be appreciated that the details of the operation and structure of the controller are not critical to the drive system of the present invention. In the illustrated embodiment the controller is a microprocessor provided with the necessary programming to perform the appropriate tasks. However, those skilled in the art will recognize that the particular controller, or the programming for the controller, may be influenced by factors beyond the scope of this invention and that there are a wide variety of controllers and programs which are suitable for use with the drive system of the present invention.

Similarly, one skilled in the art will recognize that the particular drive circuit used is not of importance to the present invention. The drive circuit in accordance with a preferred embodiment of the present drive system is capable of receiving print data from the controller and selectively activating transducers during the appropriate transducer activation periods. The particular manner in which this is accomplished may vary depending on the intended application, environment, or the preferences of the designer. It has been found that drive chips of the type frequently used on display devices are well suited as drive circuits.

It is well known that the excitation waveshape, that is a plot of the voltage applied to a transducer over time, applied to an ink jet transducer can influence the shape and velocity of the ejected ink drop. Further, variations in drop shape and velocity can result in variations in print quality and resolution. Accordingly, in many situations it is desirable to shape the drive voltage in a desired manner to achieve a desired drop shape and velocity. It is also frequently desirable for all transducers to be activated with the same excitation waveshape. A drive system in accordance with a preferred embodiment of the present invention is ideally suited to accomplish both of these goals.

In systems where the drive voltage source is constant, the excitation waveshape is largely dependant on the particular electrical characteristics of the transducer being activated. Thus, alteration of the excitation waveshape to obtain a desired, or a consistent, waveshape typically requires the use of a series network coupled to each transducer.

However, in a preferred embodiment of the present drive system, the voltage source is turned on at the beginning of each transducer activation period and turned off at the end of the transducer period. Thus, the source itself creates an excitation waveshape. Further, because the magnitude of the electrical characteristics of the transducers is substantially smaller than magnitude of the electrical characteristics of the voltage source, the excitation waveshape is relatively unaffected by the individual characteristics of the transducers or the number of transducers activated during any given transducer activation period. Thus, a drive system in accordance with the preferred embodiment inherently provides every activated transducer with substantially the same excitation waveshape.

Figure 2:
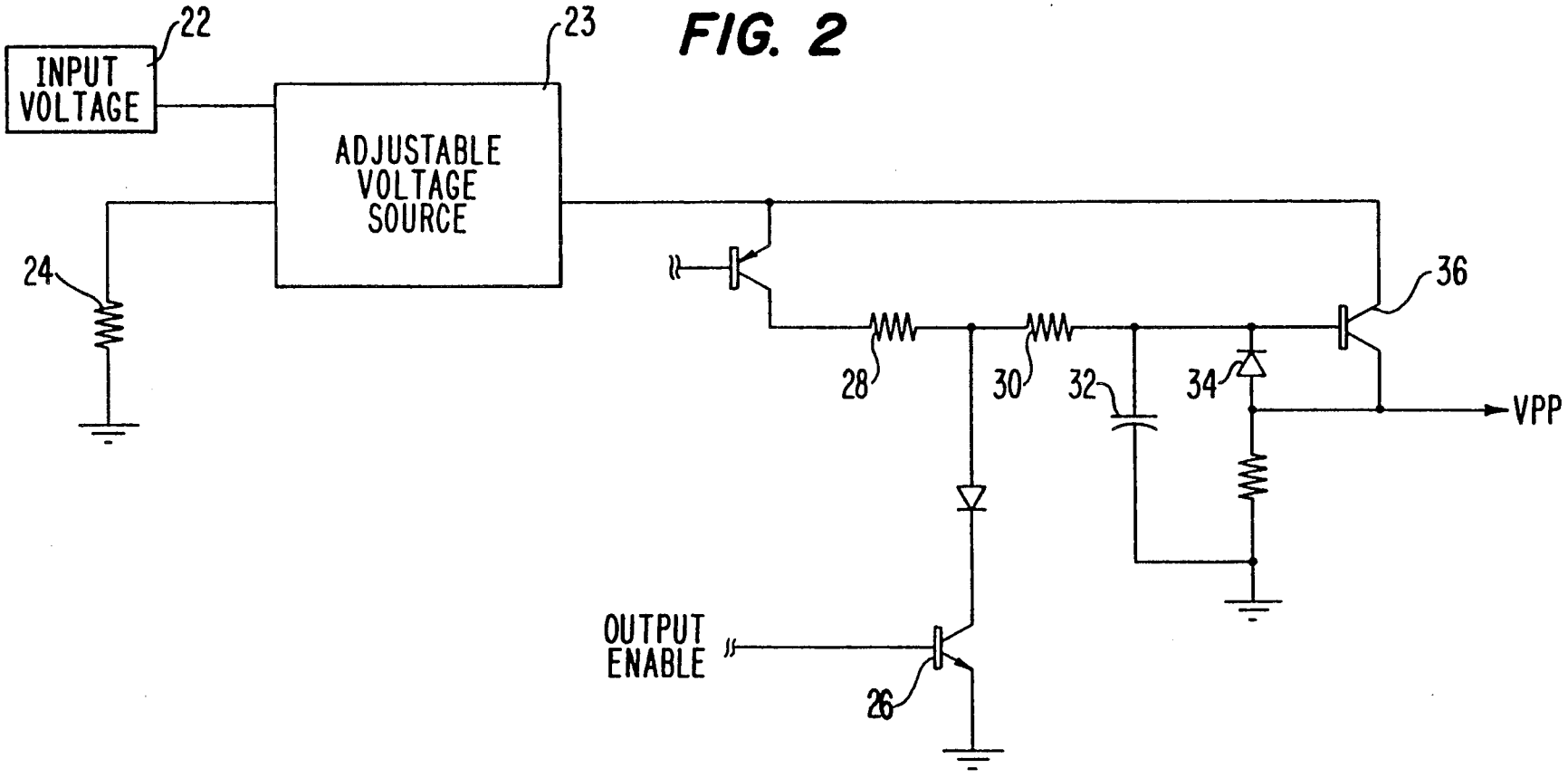
FIG. 2 is a circuit diagram of one possible voltage source and waveshape circuit for use with the drive system of FIG. 1.

Moreover, the excitation waveshape can be altered to achieve a desired shape by adding a waveshape circuit to the voltage source. One possible voltage source and waveshape circuit is illustrated in FIG. 2. The illustrated voltage source and waveshape circuit includes a constant voltage input source 22 which provides a constant voltage, approximately 55 volts in the illustrated embodiment. The constant input voltage source is supplied to an adjustable voltage source 23 where it is adjusted using a sense resistor 24 to produce a desired nominal excitation voltage. The desired nominal excitation voltage will vary depending on the particular circumstances. For example in the illustrated embodiment, a nominal excitation voltage of approximately 30–38 volts has been found to be suitable.

Figure 3:
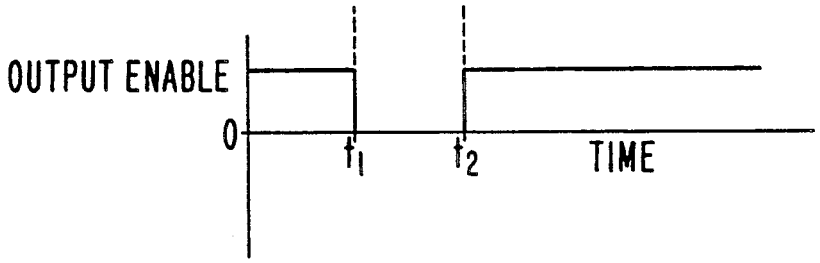
FIG. 3 shows the output enable signal supplied to the voltage source and waveshape circuit of FIG. 2.

The illustrated voltage source and waveshape circuit is activated by an output enable signal provided by the controller 16. At the beginning of each transducer activation period the controller takes the output enable signal low, approximately 0 volts in the illustrated embodiment. The output enable signal is illustrated in FIG. 3. The beginning of the transducer activation period is indicated at time $t_1$.

When the output enable signal is low, transistor 26 is off. Resistors 28 and 30 and capacitor 32 cause the voltage to rise exponentially toward the nominal voltage during the duration of the transducer activation period. Transistor 36 causes VPP, the drive voltage supplied to the print head transducers, to follow the rise time. Although the values for the various electrical elements of the waveshape circuit may vary substantially in different embodiments, in the illustrated embodiment, resistor 28 is approximately 10 kΩ, resistor 30 is approximately 2.7 kΩ, and capacitor 32 is approximately 270 pF. When the output enable is high (approximately 5 volts in the illustrated embodiment), at the end of the transducer activation period illustrated in FIG. 3 as $t_2$, the junction between resistors 28 and 30 goes low, turning off transistor 36. This removes the voltage source from VPP and allows the transducers to discharge through the drive circuit. The result is a fall in the excitation waveshape.

Figure 4:
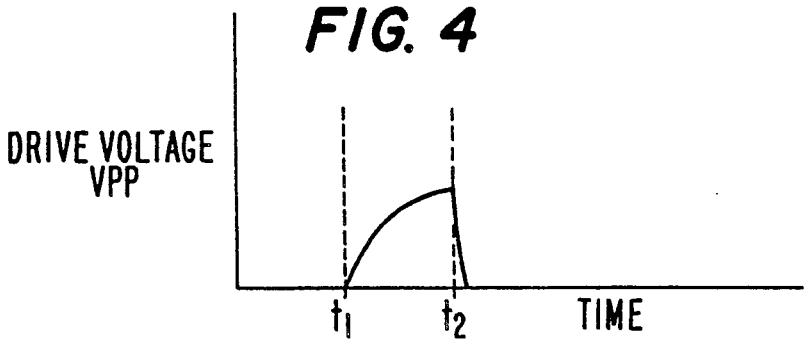
FIG. 4 shows drive voltage waveshape generated by the voltage source and waveshape circuit of FIG. 2.

FIG. 4 shows the excitation waveshape produced by the circuit illustrated in FIG. 2. However, it should be appreciated that the desired waveshape may vary depending on the desired ink drop characteristics, transducer characteristics, or a multitude of other factors. Further, for each desired waveshape, there are typically a variety of circuits which can be used to shape the voltage source. Therefore, the particular waveshape circuit is not necessarily critical to the practice of the present invention.

Referring to FIG. 1, the drive system of the present embodiment includes several stationary components, indicated collectively as reference numeral 38, and several mobile components, indicated collectively as reference numeral 40. The stationary components 38 are mounted within a printer (not shown) while the mobile components 40 are carried on the moving print head 12. As can be seen, the print head carries very few components. In particular, because the excitation waveshape is produced by turning the voltage source on and off and shaping the output voltage, it is unnecessary for each transducer to have a series network carried by the print head. The elimination of the need for series networks associated with each transducer is one major advantage of the present drive system. It allows the use of a smaller more compact head which is less cumbersome, easier to move, less expensive, and has fewer elements which are subject to failure.

This detailed description of the invention is set forth only for purposes of illustrating an example of the present invention. It should not be considered to limit the scope of the invention in any way. Clearly numerous additions, substitutions, and other modifications can be made to the invention without departing from the scope of the invention. Accordingly, the scope of the invention is best defined in the appended claims and equivalents thereof.

What is claimed is:

1. In an ink jet printer including an ink jet print head mounted for movement relative to a substrate, the ink jet print head having a plurality of transducers which are individually selectively activatable to eject ink upon receipt of a voltage pulse, a controller for determining a transducer activation period in which selected transducers are activated, the controller generating an output enable signal corresponding to the transducer activation period, and voltage source means coupled to the controller for producing waveshaped drive voltage pulses, the improvement wherein: said controller and voltage source means are physically separate from said print head and are fixed in position relative to said printer; said voltage source means have a single output for delivering the waveshaped drive voltage pulses to selected transducers; and each waveshaped drive voltage pulse has a magnitude and duration sufficient to cause selected transducers to eject ink.

2. A printer as defined in claim 1 further comprising connection means connecting said single output to all of said transducers for applying each voltage pulse across selected transducers in parallel.

3. A printer as defined in claim 2 further comprising driver means for connecting only the selected transducers in circuit with said voltage source.

4. A printer as defined in claim 3 wherein each voltage pulse has a leading edge and a trailing edge, and said voltage source means comprise a first waveshaping circuit for shaping the leading edge of each voltage pulse and second waveshaping circuit, separate from and structurally dissimilar to, said first waveshaping circuit, for shaping the trailing edge of each voltage pulse.

5. A printer as defined in claim 4 wherein said voltage source means further comprises an amplifier element having an input connected to said first waveshaping circuit, and an output terminal connected to said single output of said voltage source means.

6. A printer as defined in claim 5 wherein said second waveshaping circuit is connected to said single output of said voltage source means.

7. A method of printing on a sheet in a printer including an ink jet print head having a plurality of transducers each of which is individually selectively activatable to eject ink upon application of a drive voltage pulse thereacross, said method comprising the steps of:

producing drive voltage pulses at a source which is physically separate from the print head and is fixed in position relative to the printer;

shaping each drive voltage pulse at the source to give each pulse a leading edge which differs in shape from each said pulse trailing edge; and applying each shaped drive voltage pulse across selected transducers for causing the selected transducers to eject ink.

8. A method as defined in claim 7 wherein said step of shaping is carried out to give each shaped drive voltage pulse an exponentially rising leading edge.

* * * * *